United States Patent [19]

Hiyoshi et al.

[11] 4,186,640

[45] Feb. 5, 1980

[54] ELECTRONIC MUSICAL INSTRUMENT

[75] Inventors: Teruo Hiyoshi; Akira Nakada; Yasuji Uchiyama; Eiichi Yamaga; Eiichiro Aoki, all of Hamamatsu, Japan

[73] Assignee: Nippon Gakki Seizo Kabushiki Kaisha, Hamamatsu-shi, Japan

[21] Appl. No.: 876,913

[22] Filed: Feb. 13, 1978

[30] Foreign Application Priority Data

Feb. 16, 1977 [JP] Japan ..... 52-15920

[51] Int. Cl.[2] ..... G10H 1/00; G10H 5/00

[52] U.S. Cl. ..... 84/1.03; 84/1.17; 84/1.24; 84/DIG. 12; 84/DIG. 22

[58] Field of Search ..... 84/1.01, 1.03, 1.17, 84/1.24, DIG. 12, DIG. 22

[56] References Cited

U.S. PATENT DOCUMENTS

| | | | |
|---|---|---|---|
| Re. 28,999 | 10/1976 | Southard | 84/1.03 |
| Re. 29,144 | 3/1977 | Bunger | 84/1.01 |

*Primary Examiner*—S. J. Witkowski

*Attorney, Agent, or Firm*—Spensley, Horn, Jubas & Lubitz

[57] ABSTRACT

An electronic musical instrument comprises an automatic rhythm performance device, an automatic bass chord performance device and an automatic arpeggio performance device. Each device has its own start-stop control circuit and a control in/out terminal. When a device is start-stop controlled, a control signal appears at the control in/out terminal, whereas if a control signal is externally applied to the control in/out terminal, the device is start-stop controlled. The control in/out terminals of the respective devices are connected together by a common line so that a start-stop of one device causes the start-stop of other devices.

5 Claims, 2 Drawing Figures

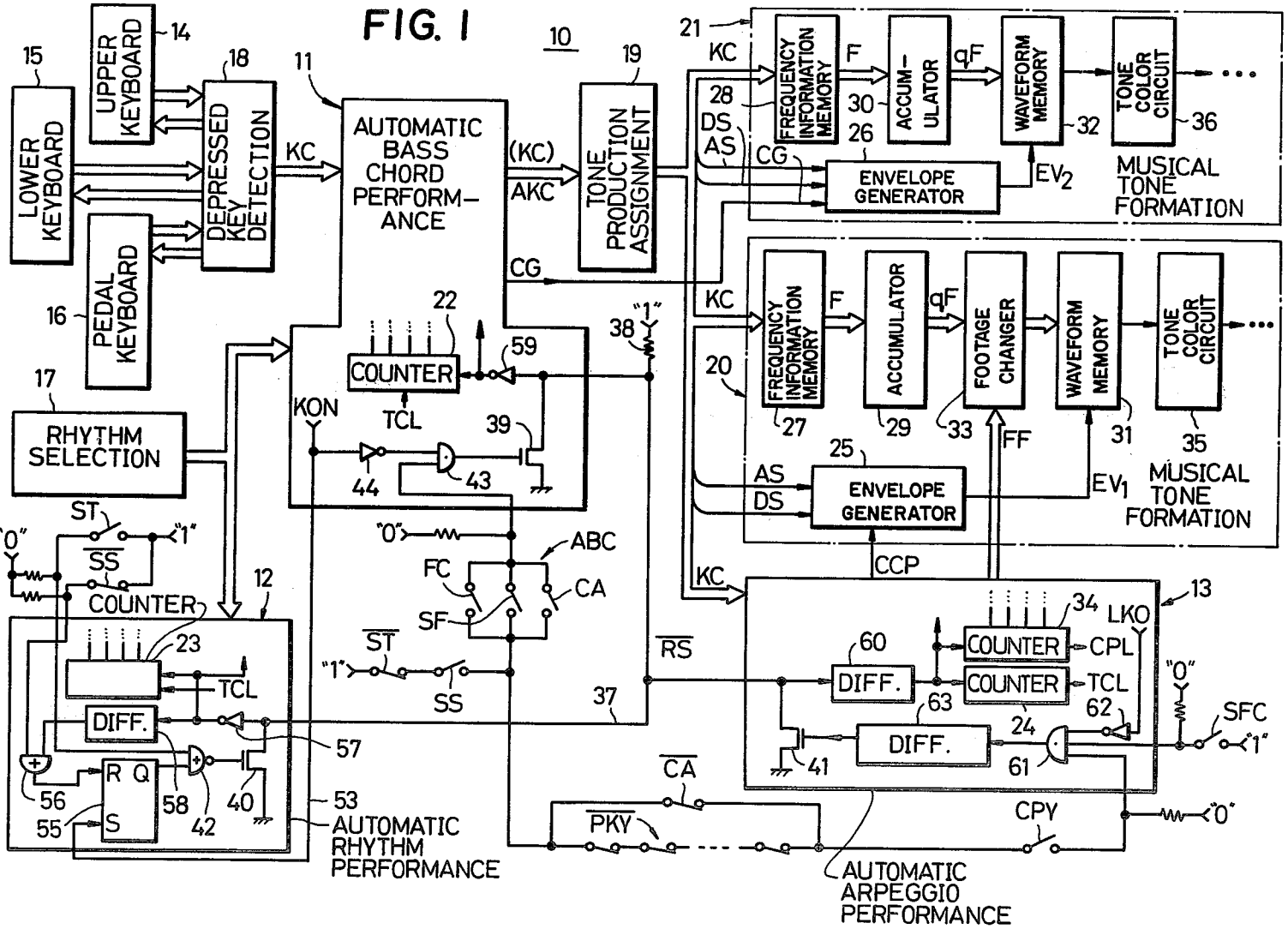
FIG. 1
10
MUSICAL TONE FORMATION
TONE COLOR CIRCUIT
WAVEFORM MEMORY
ACCUM-ULATOR
FREQUENCY INFORMATION MEMORY
ENVELOPE GENERATOR
FOOTAGE CHANGER
TONE PRODUCTION ASSIGNMENT
AUTOMATIC BASS CHORD PERFORM-ANCE
COUNTER
DIFF.
AUTOMATIC ARPEGGIO PERFORMANCE
AUTOMATIC RHYTHM PERFORMANCE
DEPRESSED KEY DETECTION
UPPER KEYBOARD
LOWER KEYBOARD
PEDAL KEYBOARD
RHYTHM SELECTION

ELECTRONIC MUSICAL INSTRUMENT

BACKGROUND OF THE INVENTION

This invention relates to an electronic musical instrument and, more particularly, to an electronic musical instrument capable of automatically controlling starting and stopping of a plurality of automatic performance devices.

Automatic performance devices known in the art of electronic musical instruments include an automatic rhythm performance device, an automatic bass chord performance device, an automatic arpeggio performance device, etc. Starting and stopping of these various automatic performance devices provided in an electronic musical instrument should preferably be conducted in synchronization with one another and not randomly and independently. Electronic musical instruments comprising these automatic performance devices normally comprise a plurality of performance selection (control) switches each of which corresponds to one of these performance devices and operation of a desired one of the automatic performance devices is started or stopped by operation of a selection switch corresponding to the desired performance. It is difficult, however, to operate the plurality of performance selection switches simultaneously; e.g., in a case where a performer desires to stop plural automatic performance devices in operation simultaneously. There is also a case where the automatic bass chord performance is conducted by depressing a key in the keyboard for designating a chord while the automatic rhythm performance is concurrently conducted. In such a case, if the performer merely releases the depressed key, the automatic bass chord performance thereby is stopped but the automatic rhythm performance is continued. Even if the performer switches off the automatic rhythm performance selection switch, the automatic rhythm performance may remain conducted for a short duration of time after stopping of the automatic bass chord due to time lag between the release of the depressed key and the switching off of the selection switch. This will give an awkward impression to the audience and therefore is not desirable.

SUMMARY OF THE INVENTION

It is therefore an object of the invention to control starting and stopping of operations of plural automatic performance devices incorporated in a single electronic musical instrument so that the operations of these performance devices are synchronized with each other if such synchronization is desired.

According to the invention, a reset signal (control signal) is mutually transmitted between the respective automatic performance devices. This reset signal is produced in one of the performance devices when a certain predetermined logical condition has been satisfied, which signal in turn is supplied to other performance devices. A condition for the production of the reset signal in one performance device generally is stopping of the automatic performance operation in that device. The rest of the performance devices which have received the reset signal stop their operations. Conditions and manners of production of the reset signal and manners of utilization of the received reset signal are not uniform but rather are different depending upon the nature of each of these devices or relations between the devices. For example, one automatic performance device may produce a reset signal continuously during stoppage of the operation thereof whereas another automatic performance device may produce a sharp and short reset signal at an instant when the condition of stopping the performance has been satisfied. Further, one automatic performance device may stop its performance while it is receiving a reset signal from other performance devices whereas another automatic performance device may store a reset signal provided thereto and stop its performance until the storage of the reset signal is released upon satisfaction of other conditions. Furthermore, still another automatic performance device may continue its performance even after receiving a reset signal from other performance device and restores its performance to an initial state in synchronization with start of operations of other automatic performance devices caused by disappearance of the reset signal. In this last case, the reset signal is used only for synchronizing the beginning of the automatic performances.

In the foregoing manner, starting or stopping of the automatic performances is synchronously controlled by exchange of a reset signal between the respective automatic performance devices. If, for example, one automatic performance is stopped when plural automatic performances are concurrently conducted, other automatic performances are automatically stopped and if one automatic performances is then started, other automatic performances are automatically resumed.

A feature of the present invention is that in synchronization with depression or release of a key in a keyboard (particularly in a keyboard used for designating a chord or a root note of the chord), an automatic performances (e.g. an automatic rhythm performance) which is originally unrelated to the key depression or key release can be started or stopped automatically. Thus, according to the invention, starting and stopping of a plurality of automatic performances can be synchronized simply by depressing or releasing a key in the keyboard.

Other objects and features of the invention will become apparent from the description made hereinbelow in conjunction with the attached drawings.

BRIEF DESCRIPTION OF THE DRAWINGS

In the drawings;

FIG. 1 is a block diagram showing an embodiment of the electronic musical instrument of the present invention.

DESCRIPTION OF THE PREFERRED EMBODIMENTS

Figure 2:
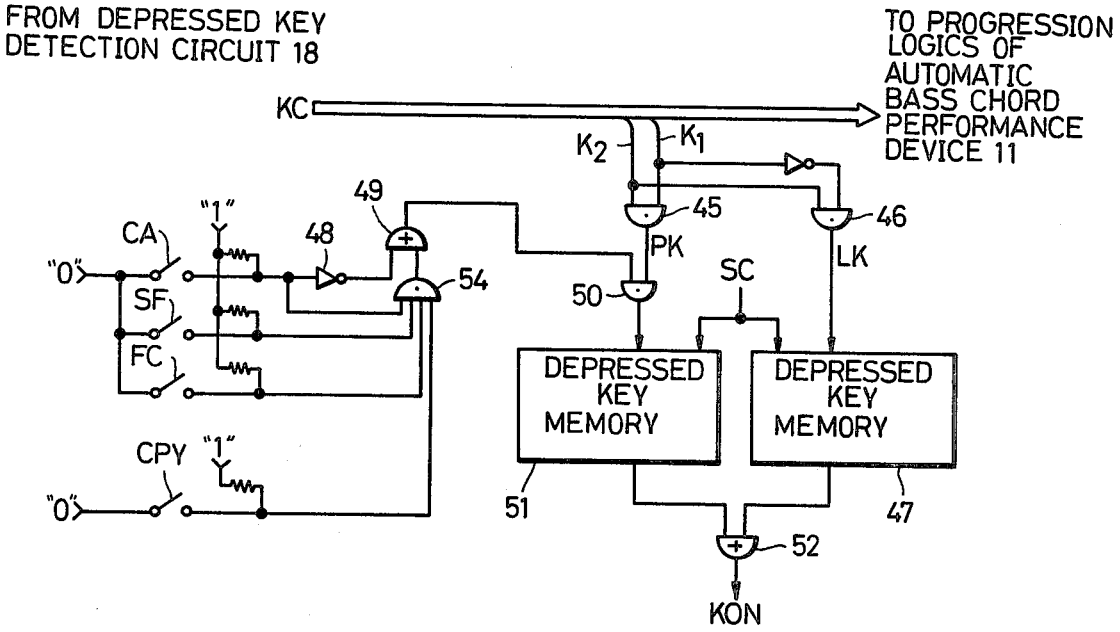
FIG. 2 is a block diagram showing an example of a circuit for generating a depressed key detection signal KON in the automatic bass chord performance device shown in FIG. 1.

Referring first to FIG. 1, an electronic musical instrument 10 comprises an automatic bass chord performance device 11, an automatic rhythm performance device 12 and an automatic arpeggio performance device 13. The electronic musical instrument is therefore capable of performing three kinds of automatic performance functions. The automatic bass chord performance device 11 is a device for providing an automatic bass performance and an automatic chord performance. In the present embodiment, the automatic bass chord performance generally is conducted by operation of keys in a lower keyboard 15. A plurality of keys in the lower keyboard 15 are depressed in the form of chord and a chord name is detected from the state of the depressed keys. A root tone and subordinate tones of the detected chord are produced one by one as automatic bass tones in accordance with a desired bass progression pattern. The subordinate tones referred to in this specification designate tones which have certain note interval relations with respect to a root tone (i.e., major second degree, minor third degree, major third degree, etc.). The bass pattern is produced through a rhythm selection circuit 17 in accordance with a desired rhythm selected by the performer. In the meanwhile, the tones for the plurality of keys depressed in the lower keyboard 15 are simultaneously produced with a suitable timing in accordance with the selected rhythm. The automatic bass chord performance device 11 is operable when an automatic bass chord performance selection switch ABC is ON. In the above described general automatic bass chord performance, the chord designation for producing chord tones is made only in one keyboard (i.e. the lower keyboard 15). It should be noted, however, that the instrument is capable of conducting a special automatic bass chord performance other than the one described above. This special function is hereinunder designated a "custom function". For performing the custom function, a custom function selection switch CA is turned on.

The switch CA has other ganged switches connected in progression logic circuit included in the automatic bass chord performance device, but they are not shown in FIG. 1 for simplicity's sake, because such circuit falls within prior art and is not an essential part of this invention. In the custom function, bass tones are automatically produced in accordance with a desired bass pattern with a tone of a single key depressed in a pedal keyboard being used as a root tone. The chord progress of the automatic bass tones in this case is determined on the basis of the kind of the chord (e.g., major, minor, seventh etc.) constituted by the plural keys depressed in the lower keyboard 15. The chord tones in the custom function are obtained by automatically controlling production of tones of the depressed keys in the lower keyboard 15.

The automatic rhythm performance device 12 is provided to produce automatic rhythm sounds (e.g. percussion instrument sounds) corresponding to a rhythm selected by the rhythm selection circuit 17.

The automatic arpeggio performance device 13 is provided to carry out an automatic arpeggio performance. An automatic arpeggio is a musical performance according to which a tone or tones of one key of more keys depressed in a chord form are sequentially produced one by one in the order of tone pitch and this sequential production of the tones is repeated over several octaves whereby rise or fall of the produced tones is repeated. In the present embodiment, the automatic arpeggio tones are designated by key depression in the lower keyboard 15. For operating the automatic arpeggio performance device 13, an automatic arpeggio performance selection switch CPY is turned on. For operating the automatic rhythm performance device 12, a rhythm start switch ST is turned on. A rhythm start switch $\overline{ST}$ of a normally closed contact type is operated in association with the rhythm start switch ST of a normally open contact type. The automatic arpeggio performance device 13 also includes progression logics for designating patterns of the tone progression in this block 13, but they are not shown in FIG. 1 for simplicity's sake, because such circuit falls within prior art and is not an essential part of this invention.

The present embodiment comprises two musical tone forming systems 20 and 21 which are provided in parallel. In the systems 20 and 21, a plurality of tones (e.g. 12 tones at maximum) can be produced concurrently in a time division manner. A tone production assignment circuit 19 is a circuit provided for assigning production of each tone designated by the key depression to either one of twelve time division tone production assignment channels. For example, one channel is exclusively assigned for production of tones of the pedal keyboard 16 and tones of an upper keyboard 14 and the lower keyboard 15 are assigned to the other eleven channels. The automatic bass chord performance device 11 functions to cause tone production so that the automatic bass tones are produced as tones of the pedal keyboard 16 and the automatic chord tones are produced as tones of the lower keyboard 15. The automatic arpeggio performance control device 13 functions to cause tone production so that tones of the lower keyboard 15 are produced as the automatic arpeggio tones. Accordingly, the same tones of the lower keyboard 15 are separately utilized as the automatic chord tones and the automatic arpeggio tones so that the musical tone forming systems 20 and 21 must be separately used for the automatic chord tones and the automatic arpeggio tones. For example, the musical tone forming system 20 is used for producing the automatic arpeggio tones. The timing of production of the lower keyboard tones in the system 20 is controlled by an automatic arpeggio tone production timing signal CCP outputted from the automatic arpeggio performance device 13. The musical tone forming system 21 is used for producing the automatic chord tones. The timing of production of the lower keyboard tones in the system 21 is determined by an automatic chord tone production timing signal CG outputted from the automatic bass chord performance device 11. The automatic bass tones produced as the pedal keyboard tones are produced both in the system 20 and 21. The automatic rhythm performance device 12 also comprises progression logics such as a rhythm pattern encoder and percussion instrument sound sources and produces the rhythm sounds automatically, but they are not shown in FIG. 1 for simplicity's sake, because such circuits fall within prior art and is not an essential part of this invention.

In FIG. 1, entire circuits of the automatic bass chord performance device 11, the automatic rhythm performance device 12 and the automatic arpeggio performance device 13 are not shown in detail, but a control section, i.e. a portion controlling the start and stop of the performance and being related to a mutual reset control between the respective devices 11, 12 and 13 which constitutes an essential portion of the invention is shown in detail. The remaining portions of the devices 11, 12 and 13 which are not shown may be constructed of any known devices.

Before explaining about the mutual reset control between the devices 11, 12 and 13, the rest of the circuit portion of the electronic musical instrument 10 shown in FIG. 1 will be briefly described.

A depressed key detection circuit 18 detects keys depressed in the upper keyboard 14, lower keyboard 15 and pedal keyboard 16 and thereupon produces a key code KC representing the depressed keys. The key code KC is constituted, for example, of nine bits as shown in Table 1 consisting of a 2-bit keyboard code $K_1$, $K_2$ which represents the keyboard kind, a 3-bit octave code $B_1$, $B_2$, $B_3$ which represents an octave range from the first octave through the sixth octave and a 4-bit note code $N_1$, $N_2$, $N_3$, $N_4$ which represents twelve note names C-B within one octave.

Table 1

| | | Key code KC | | | | | | | | |
|---|---|---|---|---|---|---|---|---|---|---|
| | | $K_2$ | $K_1$ | $B_3$ | $B_2$ | $B_1$ | $N_4$ | $N_3$ | $N_2$ | $N_1$ |
| | Upper | 0 | 1 | | | | | | | |
| Keyboard | Lower | 1 | 0 | | | | | | | |
| | Pedal | 1 | 1 | | | | | | | |
| | 1st | | | 0 | 0 | 0 | | | | |
| | 2nd | | | 0 | 0 | 1 | | | | |
| | 3rd | | | 0 | 1 | 0 | | | | |
| Octave | 4th | | | 0 | 1 | 1 | | | | |
| | 5th | | | 1 | 0 | 0 | | | | |
| | 6th | | | 1 | 0 | 1 | | | | |
| | C# | | | | | | 0 | 0 | 0 | 0 |
| | D | | | | | | 0 | 0 | 0 | 1 |
| | D# | | | | | | 0 | 0 | 1 | 0 |
| | E | | | | | | 0 | 1 | 0 | 0 |
| | F | | | | | | 0 | 1 | 0 | 1 |
| Note | F# | | | | | | 0 | 1 | 1 | 0 |
| | G | | | | | | 1 | 0 | 0 | 0 |
| | G# | | | | | | 1 | 0 | 0 | 1 |
| | A | | | | | | 1 | 0 | 1 | 0 |
| | A# | | | | | | 1 | 1 | 0 | 0 |
| | B | | | | | | 1 | 1 | 0 | 1 |
| | C | | | | | | 1 | 1 | 1 | 0 |

The key code KC outputted from the depressed key detection circuit 18 is applied to the tone production assignment circuit 19 through the automatic bass chord performance device 11. In the present embodiment, one of three function modes of the automatic bass chord performance can be selected. More specifically, an automatic bass chord performance selection switch ABC comprises a finger chord function selection switch FC, a single finger function selection switch SF and a custom function selection switch CA. These switches have other ganged switches connected in the progression logic circuit included in the block 11, but they are omitted in the figure for simplicity's sake. The finger chord function is a function enabling automatic production of chord tones by depressing in a chord form a plurality of keys in a keyboard assigned for a chord tone performance (i.e., the lower keyboard 15 in this embodiment) as well as enabling automatic production of bass tones corresponding to the chord. The single finger function is a function enabling production of a root tone of a chord by depressing a single key in the keyboard assigned for producing chord tone and further producing subordinate tones of the chord on the basis of this root tone as well as enabling automatic production of bass tones corresponding to the chord. The custom function is a function enabling automatic production of bass tones corresponding to a chord, tones being designated on the lower keyboard 15 and the root and the subordinate bass tones being designated on the pedal keyboard 16. In the illustrated automatic bass chord performance selection switch ABC, the three switches FC, SF and CA are connected in parallel in the form of an OR logic so that the automatic bass chord performance device will be in operation when one of the switches FC, SF and CA is ON. It should be noted, however, that these switches FC, SF and CA actually have respective ganged switches which are individually associated with other circuit portions in the automatic bass chord performance device 11 and enable or disenable necessary circuit portions.

If the finger chord function or the single finger function is selected, the automatic bass chord performance device 11 automatically produces, at predetermined timing, key codes AKC which is required for the bass and chord performances on the basis of the key codes KC representing the depressed keys in the lower keyboard 15 and provided by the depressed key detection circuit 18. If the custom function is selected, the device 11 produces key codes AKC required for the automatic bass performance (for walking bass) using the key code KC provided by the depressed key detection circuit 18 representing the depressed key in the pedal keyboard 16 as the root note and generating the key codes KC for the subordinate notes. In this case, the chord form is determined in accordance with the type of the chord, i.e., note interval relation of the chord, detected on the basis of the key codes KC of the depressed keys in the lower keyboard 15.

In short, the automatic bass chord performance device 11 automatically produces the key codes AKC for tones constituting the automatic bass tones and the automatic chord tones as if keys for these tones were depressed, and supplies these key codes AKC to the tone production assignment circuit 19. In this case, the keyboard code $K_2$, $K_1$ "11" representing the pedal keyboard 16 is given to make the key codes AKC of the automatic bass tones whereas the keyboard code $K_2$, $K_1$ "10" representing the lower keyboard 15 is given to make the key codes AKC of the automatic chord tones. The bass tones are monophonic and the key code AKC for each individual automatic bass tone is produced one by one in synchronism with a predetermined tone production timing for producing bass tones of respective notes in accordance with a selected bass pattern. The chord tones are polyphonic and the key codes AKC of tones constituting the chord are outputted in a time division manner and treated in the tone production assignment circuit 19 as if keys for these tones constituting the chord were being continuously depressed. Accordingly, timing of producing the chord tones is determined in accordance with a chord tone production timing signal CG which is separately produced in response to a selected rhythm. The chord tone production timing signal CG is applied to the musical tone forming system 21 to cause a plurality of tones belonging to the lower keyboard and formed in the system 21 to be produced simultaneously at the timing of the signal CG. Timing elements of the bass pattern for producing the automatic bass tones and time elements for producing the chord tone production timing signal CG are formed by a tempo counter 22. The tempo counter 22 in the performance device 11 counts basic tempo clock pulses TCL which are also counted by the tempo counter 23 in the performance device 12.

A tempo counter 23 is similarly provided in the automatic rhythm performance device 12 for counting the basic tempo clock pulse TCL and thereby establish time elemen elements of the automatic rhythm performance. The basic tempo clock pulse TCL is outputted from a basic tempo counter 24 provided in the automatic arpeggio performance device 13.

The tone production assignment circuit 19 receives the key code KC from the depressed key detecting circuit 18 or the key code AKC from the automatic bass chord performance device 19, and assigns the tone production of the key (note) represented by the key code to one of the channels corresponding to the maximum number of simultaneous tone production (12 notes, for instance). The tone production assignment circuit 19 has memory positions defining the respective channels, for instance, and operates to store the key code representative of a key in a memory position corresponding to a channel to which the tone production of the key is assigned. The circuit 19 successively outputs the key codes KC stored in the channels as time division multiplexed signals.

In addition, the tone production assignment circuit 19 outputs attack start signals (or key-on signals) AS in time division and in synchronization with the channel times, which represent that the tones of depressed keys should be produced in the channels to which the tone productions of the keys are assigned. Furthermore, the circuit 19 outputs in time division and in synchronization with the channel times decay start signals (or key-off signals) DS representing that keys whose tone productions are assigned to the channels are released. These signals AS and DS are utilized in envelope generators 25 and 26 for the amplitude envelope control (tone production control) of musical tones.

The key code KC thus produced repeatedly in synchronism with its channel time is supplied to frequency information memories 27 and 28 and the automatic arpeggio performance device 13.

The frequency information memories 27 and 28 store frequency information F (constants) corresponding to the key codes KC of the respective keys. These memories 27 and 28 are composed, for example, of a read-only memory. When a certain key code KC is applied to these memories, frequency information F stored at an address designated by the key code KC is read out. The frequency information F is regularly and successively accumulated by accumulators 29 and 30 and used for sampling the amplitude of the musical tone at a predetermined interval. Accordingly, the frequency information F is a digital value proportional to the musical tone frequency for the key. The value of the frequency information F is determined if the value of the musical tone frequency is determined at a certain constant sampling speed. Assume, for example, that sampling of one musical tone waveform has been completed when a value qF (where q=1, 2, 3 . . .) obtained by successively accumulating the frequency information F by the accumulators 29 and 30 has reached 64 in a decimal notation and that this accumulation is completed every 12 microseconds in which one circulation of the entire channel times is completed. The value of the frequency information F is determined by an equation $$F=12\times 64\times f\times 10^{-6}$$

where f is a frequency of the musical tone. This value F is stored in the frequency information memories 27 and 28 in accordance with the frequency f to be obtained.

Each of the accumulators 29 and 30 are composed of a counter which cumulatively adds the frequency information F of the respective channels at a predetermined sampling rate (i.e., at a rate of 12 microseconds for each channel time) to obtain a cumulative value qF and thereby advances the phase of the musical tone waveform. When the cumulative value qF has reached 64 in a decimal notation, the accumulator overflows and returns to 0 thereby completing reading out of one waveform. For accumulating data F of the respective channels, the accumulators may preferably be composed of an adder of plural stages and a shift register of 12 stages corresponding to the number of the channels.

A tone source waveform is divided into a plurality of sample points (e.g. 64) and amplitude values at respective sample points are stored in the respective addresses in waveform memories 31 and 32. The value qF which is the output of the accumulators 29 and 30 constitutes an input designating the address to be accessed in the memories 31 and 32. Musical tone waveforms (tone source waveforms) of tones assigned to the respective channels are read out in a time division manner from the waveform memories 31 and 32 in response to the value qF provided in time division for each of the channels.

A footage change circuit 33 inserted between the accumulator 29 and the musical tone waveform memory 31 is constructed in such a manner that a binary digit positions of the cumulative value qF outputted from the accumulator 29 is suitably shifted in accordance with the octave switching signal FF. The output qF of the accumulator 29 is applied directly to a corresponding one of the waveform memory 31 if the octave change is not designated. If the octave change has been designated by the signal FF, the value qF is converted to a value which is double, four times or eight times . . . as large as the original value in accordance with the amount of the octave change and thereafter is applied to the waveform memory 31.

By converting the value qF to a valve which is double, four times or eight times . . . as large as the original value by the footage change circuit 33, a sampled amplitude value at an address which is advanced by double, four times, eight times . . . from the address designated by the original value qF is read from the waveform memory 31. This means that the musical tone frequency obtained becomes double, four times, eight times . . . and, accordingly, the tone pitch of the produced tone is raised by one octave, two octaves, three octaves and so on.

The octave switching signal FF for specifying an octave switching amount is supplied from the automatic arpeggio performance device 13. The automatic arpeggio performance device 13 is adapted to automatically effect an arpeggio performance, i.e. a successive sounding of chord tones one by one. In this device 13, the key codes for the lower keyboard out of the key codes KC supplied thereto by the tone production assignment circuit 19 are selected in the order of tone pitches for each predetermined tone production timing and an arpeggio tone production command signal CCP is produced in synchronization with the channel time to which the selected key code KC is assigned. When the automatic arpeggio performance device 13 is operated, the tone of a depressed key in the lower keyboard 15 or the tone concerning the key code AKC for automatic chord performance which is automatically formed by the automatic bass chord performance device 11 is automatically produced in arpeggio. In an automatic arpeggio performance employing the automatic arpeggio performance device 13, the octave of a produced tone can be automatically switched, and the footage change data FF representative of the amount of switching octave is outputted by the device 13.

The automatic arpeggio tone production time signal CCP is supplied to the envelope generator 25 to cause the latter to produce an envelope shape signal (e.g. a percussion envelope) in time division in synchronization with the channel time at which the signal CCP is produced. An envelope signal $EV_1$ produced by the envelope generator 25 is supplied to the waveform memory 31 to control the amplitude envelope of the tone source waveform signal. Accordingly, the automatic arpeggio tones are sounded intermittently one by one with the timing of generation of the tone production timing signal CCP.

Assume, for example, that the key codes KC of $C_4$, $E_4$ and $G_4$ tones provided with the keyboard code $K_2$, $K_1$ of the lower keyboard are assigned to the first, second and third channels from the tone production assignment circuit 19 and being outputted in a time division manner. If an automatic arpeggio tone production timing signal CCP is generated in this state in synchronization with the first channel time, an envelope signal $EV_1$ is generated in time division in synchronization with the first channel time and a tone signal for the $C_4$ tone assigned to the first channel is outputted with an envelope from a waveshape memory 31. At this time, the tones of the remaining lower keyboard tones $E_4$ and $G_4$ are not produced.

When the automatic arpeggio tone production timing signal CCP is generated in synchronization with the second channel time upon lapse of a predetermined time from generation of the $C_4$ tone, the envelope signal $EV_1$ is produced in synchronization with the second channel time and the $E_4$ tone assigned to the second channel is produced. When the tone production timing signal CCP is generated in synchronization with the third channel time, the $G_4$ tone assigned to the third channel is produced from the musical tone forming system 20. The sequential tone production described above is repeated thereafter and the octave is changed in accordance with the signal FF. Thus, a musical performance effect resembling arpeggio is obtained.

In the automatic arpeggio performance device 13, the tempo clock pulse CPL used for controlling a periodical generation of the tone production timing signal CCP is outputted from an automatic arpeggio tempo counter 34. The basic tempo counter 24 and the automatic arpeggio tempo counter 34 are provided separately from each other for providing basic tempo clock pulses used for the automatic arpeggio performance separately from basic tempo clock pulses used for the automatic rhythm performance and the automatic bass chord performance. The basic tempo counter 24 always counts synchronizing clock pulses (not shown) and outputs basic tempo clock pulses TCL. The automatic arpeggio tempo counter 34 counts the synchronizing pulses and produces automatic arpeggio tempo clock pulses CPL upon turning on of a synchronizing clock selection switch SFC for synchronizing tempo. In this case, the clock pulse TCL and the clock pulse CPL are synchronized with each other. When it is not necessary to synchronize the automatic arpeggio system with the automatic rhythm performance system, the synchronizing clock selection switch SFC is turned off and the clock pulse CPL is generated by counting free clock pulses (not shown) by the automatic arpeggio counter 34. The synchronizing clock pulse and the free clock pulse are generated by separate pulse sources so that their frequencies can be individually adjusted.

The envelope generator 26 of the musical tone forming system 21 is provided with the chord tone production timing signal CG from the automatic bass chord performance control device 11. The envelope generator 26 produces, upon receipt of the chord tone production timing signal CG, the same envelope signal $EV_2$ with respect to all channels to which the lower keyboard tones are assigned thereby uniformly controlling the amplitude envelopes of the lower keyboard tones read from the waveshape memory 32. The lower keyboard tones therefore are read out simultaneously. Taking, for example, the case where the $C_4$, $E_4$ and $G_4$ tones are selected, the envelope generator 26 produces, upon receipt of the tone production timing signal CG, three shots of the envelope signal $EV_2$ in time division in synchronization with the first, second and third channel times to which the $C_4$, $E_4$ and $G_4$ tones are assigned thereby providing these tones with the amplitude envelope substantially simultaneously. Accordingly, a plurality of lower keyboard tones are simultaneously produced in response to the tone production timing signal CG and the chord effect thereby is produced.

The tone signals read from the waveshape memories 31 and 32 are processed in tone color circuits 35 and 36 for providing tone colors thereto with respect to each keyboard and thereafter are used for sounding tones through a suitable known circuit. The automatic bass tones produced as the pedal keyboard tones are formed both in the musical tone forming system 20 and 21. Both bass tones formed in the system 20 and 21 may be sounded or either one of them may be selectively sounded.

As the depressed key detection circuit 18 and the tone production assignment circuit 19, the key coder and the channel processore described in the specification of U.S. Pat. No. 4,114,495 assigned to the same assignee as the present application, may be employed. Further, as the automatic bass chord performance device 11, the device described in the specification of U.S. Patent application Ser. No. 825,443, filed Aug. 17, 1977, may be employed and, as the automatic arpeggio performance device 13, the device described in the specification of U.S. patent Ser. No. 4,158,978 may be employed. This patent and application are assigned to the same assignee as the present application. In FIG. 1, only the start-stop control portions of the respective performance devices are shown and the rest of the circuits including progression logics are omitted, as the formers are the essential parts of the present invention.

A reset signal $\overline{RS}$ is transmitted through a mutual reset line 37 between the automatic bass chord performance device 11, the automatic rhythm performance device 12 and the automatic arpeggio performance device 13. A signal "1" is supplied to the mutual reset line 37 through a resistor 38. When the reset signal $\overline{RS}$ is generated from either of the performance devices (11, 12 and 13), the signal on the line 37 becomes "0" whereby the reset signal $\overline{RS}$ ("0") is supplied to all of the control devices 11, 12 and 13. In other words, when the signal on the line 37 is "0", the respective devices 11, 12 and 13 is provided with the reset signal $\overline{RS}$ and when the signal on the line 37 is "1", the devices are not provided with the reset signal.

If generation of the reset signal $\overline{RS}$ from any of the devices 11, 12 and 13 is desired, a corresponding one of field-effect transistors 39, 40 and 41 provided in the respective devices 11, 12 and 13 is turned on and the signal on the mutual reset line 37 through which the drains of the transistors 39, 40 and 41 are commonly connected thereupon becomes "0" (e.g., ground potential). The mutual reset line 37 constitutes a common input-output line (in/out terminal) for the reset signal $\overline{RS}$ in the respective devices 11, 12 and 13. In the case where the reset signal $\overline{RS}$ is outputted from the devices 11, 12 and 13, the signal "0" is supplied from the drain side of the field-effect transistors 39, 40 and 41 to the line 37 whereas in the case where the reset signals $\overline{RS}$ is inputted to the devices 11, 12 and 13, the signal "0" is supplied to an inverter 59 or 57 of a differentiation circuit in the devices 11, 12 and 13.

The circuits including the field effect transistors 39–41 which are grounded on their source side and commonly connected on the drain side and connected to a signal "1" through a resistor 38 constitute a kind of OR gate and the voltage on the drain side of the transistors (39–41) which are in an off state changes in accordance with the voltage of the signal on the line 37. Accordingly, if any one of the transistors 39–41 is turned on (i.e., the reset signal $\overline{RS}$ is produced in any one of the devices 11–13) and the signal on the line 37 thereby becomes "0", the reset signal $\overline{RS}$ ("0") is supplied to all of the performance devices 11, 12 and 13.

Conditions for turning on the field-effect transistors 39, 40 and 41, e.g., conditions for generation of the reset signal $\overline{RS}$, are somewhat different depending upon the nature of the automatic performance functions performed by the devices 11, 12 and 13.

According to the automatic performance functions controlled by the automatic bass chord performance device 11 and the automatic arpeggio performance device 13, a chord or a root tone or plural notes to be sequentially produced in a broken chord (Alberti bass) form are designated by key depression in a keyboard i.e., the lower keyboard 15 or the pedal keyboard 16. Accordingly, depression of a key is one condition of starting these automatic performance functions. On the other hand, the performance function achieved by the automatic rhythm performance device 12 does not normally require key depression. More specifically, the automatic rhythm performance device 12 is actuated to produce the automatic rhythm tones by turning on the rhythm start switch ST. With regard to the reset signal $\overline{RS}$, the signal "1" is applied to a NOR circuit 42 in the automatic rhythm performance device 12 through the rhythm start switch ST upon turning on of the switch ST thereby changing the output of the NOR circuit 42 to "0". This causes the field-effect transistor 40 to be turned off. On the other hand, the normally closed contact type switch $\overline{ST}$ is opened by turning on of the rhythm start switch ST causing the transistors 39 and 41 in the other devices 11 and 13 to be turned off as will be described more fully later. Accordingly, the reset signal $\overline{RS}$ is not supplied to the line 37 from any of the performance devices 11, 12 and 13 so that the signal on the line 37 is "1". The automatic rhythm performance device 12 performs its operation unless it produces or receives the reset signal $\overline{RS}$, so that the automatic rhythm performance is always made when the rhythm start switch ST is turned on.

By turning off the rhythm start switch ST and turning on a synchronization start switch SS, the reset signal $\overline{RS}$ can be extinguished or produced in synchronization with depression or release of keys in the lower keyboard 15 or the pedal keyboard 16 and the automatic rhythm performance function can thereby be started or stopped in synchronization with the operation of keys. The normally open contact SS and the normally closed contact $\overline{SS}$ of the synchronization start switch SS are ganged with each other so that the normally open contact SS is closed and the normally closed contact $\overline{SS}$ is opened by turning on of the synchronization start switch SS.

If the rhythm start switch ST is turned off and the synchronization start switch SS is turned on, the reset signal $\overline{RS}$ can be generated from the devices 11, 12 and 13 under certain conditions, as will be described later. If the rhythm start switch ST is turned on and the synchronization start switch SS is turned off, the reset signal $\overline{RS}$ can be generated only from the side of the automatic rhythm performance device 12. In this case, upon closing the synchronization start switch $\overline{SS}$, a signal "1" is applied to a reset input R of a flip-flop 55 through an OR gate 56, so that the flip-flop 55 is reset. Accordingly, the output Q of the flip-flop 55 is "0" which is applied to the NOR circuit 42. The NOR circuit 42 also receives a signal "1" from the rhythm start switch ST which is in an ON state. If the rhythm start switch ST is turned off for stopping the automatic rhythm performance, a signal "0" is applied to the other input of the NOR circuit 42 to turn the output thereof to "1" and thereby turn on the transistor 40. Thus, the reset signal $\overline{RS}$ is produced from the side of the automatic rhythm performance device 12.

The reset signal $\overline{RS}$ supplied to the respective devices 11 through 13 via the mutual reset line 37 is utilized for resetting the tempo counters 22, 23, 24 and 34 provided in the performance devices 11 through 13 as well as for various circuits (not shown) required for starting and stopping controls of the automatic performances.

In the automatic bass chord performance device 11 and the automatic rhythm performance device 12, the reset signal $\overline{RS}$ ("0") provided through the mutual reset line 37 of or through conduction of their transistors 39 and 40 is inverted by inverters 57 and 59 and the inverted signal "1" is used for resetting the tempo counters 22 and 23. By frequency dividing the basic tempo clock pulse TCL, the tempo counter 22 produces basic pulse signals having various frequencies used for generating pattern pulses establishing timing of production of the automatic bass tones and the automatic chord tones. The tempo counter 23 likewise frequency divides the basic tempo clock pulse TCL and thereby produces basic pulse signals having various frequencies used for generating pattern pulse establishing timing of production of the automatic rhythm tones. Accordingly, when these tempo counters 22 and 23 are reset, the basic pulse signals establishing the tone production timing ceases to be produced whereby production of the automatic rhythm tones, the automatic bass tones and the automatic chord tones is stopped. The manner of using the reset signal $\overline{RS}$ in the automatic arpeggio performance device 13 is different from those described above and a detailed description thereof will be made later.

The case wherein the reset signal $\overline{RS}$ is automatically produced in accordance with operation of keys will now be described. In this case, assume that the rhythm start switch ST is in an off state and the synchronization start signal SS is in an on state.

Generation of the reset signal $\overline{RS}$ from the automatic bass chord performance device 11 will first be described. The gate of the field-effect transistor 39 in the automatic bass chord performance device 11 receives the output of an AND gate 43. When the AND gate 43 is enabled, the reset signal $\overline{RS}$ is generated from the side of the automatic bass chord performance device 11. If the output of the AND gate 43 is designated by a reference character RSabc, a condition that the output RSabc becomes "1" is $$RSabc = ABC \cdot SS \cdot \overline{ST} \cdot \overline{KON} \quad (1)$$

In this logical equation, ABC designates a condition which becomes "1" if any one of the switches FC, SF and CA is in an on state in the automatic bass chord performance selection switch ABC and the automatic bass chord performance device 11 thereby is in operation. SS designates a condition which becomes "1" if the synchronization start switch SS is ON. $\overline{ST}$ designates a condition which becomes "1" if the rhythm start switch ST is OFF. $\overline{KON}$ designates a condition which becomes "1" if no key is being depressed in the keyboard. In the illustrated embodiment, the rhythm start switch $\overline{ST}$, the synchronization start switch SS and the automatic bass chord performance selection switch ABC are connected in series to one input of the AND gate 43 for satisfying the above logical equation (1) and the signal $\overline{KON}$ which is obtained by inverting the depressed key detection signal KON is applied to the other input of the AND gate 43. Accordingly, if the automatic bass chord performance has been selected (i.e. the switch ABC is ON), the synchronization start switch SS is ON and the rhythm start switch ST is OFF (i.e., the contact $\overline{ST}$ is closed), a signal "1" is applied to one input of the AND GATE 43. If, in this state, the depressed key detection signal KON is turned to "0" by release of key, the inverted signal $\overline{KON}$ becomes "1" and the output of the AND gate 43 becomes "1". The transistor 39 is turned on by this output "1" of the AND gate 43 and the signal on the mutual reset line 37 becomes "0" whereby the reset signal $\overline{RS}$ is supplied to the respective devices 11, 12 and 13. The release of key means that the depressed key detection signal KON is "0". This signal KON is generated by a circuit as shown in FIG. 2 provided in the automatic bass chord performance device 11. As will become apparent from description of the circuit shown in FIG. 2, "release of key" means that no key is being depressed in the lower keyboard 15 or the pedal keyboard 16 used for the automatic bass chord performance.

In the circuit shown in FIG. 2, an AND gate 45 is provided for detecting supply of the key code KC of the pedal keyboard 16 from the depressed key detection circuit. The AND gate 45 produces an output "1", i.e., a pedal keyboard key depression detection signal PK when the keyboard code $K_2$, $K_1$ is "11". An AND gate 46 is provided for detecting supply of the key code KC of the lower keyboard 15 from the depressed key detection circuit 18. The AND gate 46 produces an output "1", i.e., a lower keyboard key depression detection signal LK when the keyboard code $K_2$, $K_1$ is "10". In the automatic bass chord performance of the present embodiment, the lower keyboard 15 is used in any of the finger chord function, the single finger function and the custom function. The pedal keyboard is used only in the custom function. Accordingly, the lower keyboard key depression detection signal LK is stored in a lower keyboard key depression memory circuit 47 no matter which function has been selected. If the custom function has been selected, the custom function selection switch CA is turned on and a signal "1" thereby is applied to an AND gate 50 through an inverter 48 and an OR gate 49. The pedal keyboard key depression detection signal PK is gated out of the AND gate 50 and stored in a pedal keyboard key depression memory circuit 51. The memory circuit 47 and 51 produces a signal "1" continuously on the output side thereof if it receives the key depression detection signal LK or PK even once during one period of the signal SC (e.g. of the order of 5 ms) which is regularly supplied thereto. These memory circuits therefore perform the function of converting the signal LK or PK generated in time division into a kind of direct current. If according, any key is being depressed in the lower keyboard, key depression memory circuit 47 produces a signal "1" as a direct current. In the case where the constom function has been selected, the pedal keyboard key depression memory circuit 51 produces a signal "1" as a direct current if any key is being depressed in the pedal keyboard. The output of the memory circuits 47 and 51 are combined by an OR gate 52 to constitute the depressed key detection signal KON representing that a key is being depressed in the keyboard assigned for the automatic performance (i.e., the lower keyboard 15 or the pedal keyboard 16).

The manner in which the reset signal $\overline{RS}$ is generated from the automatic bass chord performance device 11 will now be described.

Assume now that the switch ST is OFF and the switch SS is ON so that a synchronized state is set, the automatic bass chord performance is possible (i.e., the switch ABC is ON) and the automatic bass tones and the automatic chord tones are being produced in the musical tone forming systems 20 and 21 by depression of a desired key in the lower keyboard 15 or the pedal keyboard 16. If in this state the depressed key in the keyboard assigned for the automatic performance is released, production of the automatic bass tones and the automatic chord tones is stopped (or these tones are attenuated) and, simultaneously, the depressed key detection signal KON becomes "0". This enables the AND gate 43 and the reset signal $\overline{RS}$ is generated from the side of the automatic bass chord performance device 11. The automatic bass tones and chord tones are stopped or attenuated because designation of the chord or the root tone is stopped upon release of the key.

The depressed key detection signal KON is used not only in the automatic bass chord performance device 11 but also in the automatic rhythm performance device 12 through a line 53. For this reason, storage of the pedal keyboard key depression detection signal PK in the memory circuit 51 is controlled by the output of an AND gate 54 also as will be described more fully later.

The condition for generation of the reset signal $\overline{RS}$ from the side of the automatic rhythm performance device 12 is that both inputs to the NOR circuit 42 become "0". The NOR circuit 42 receives in the one input thereof a signal "0" from the rhythm start switch ST which is in an OFF state. Accordingly, the output of the NOR circuit 42 becomes "1" or "0" in accordance with the state of a flip-flop 55 connected to the other input of the NOR circuit 42. If the flip-flop 55 is reset and its output Q thereby becomes "0", the output of the NOR circuit 42 becomes "1". This brings the transistor 40 into conduction and thereby causes the reset signal $\overline{RS}$ to be produced. On the other hand, if the flip-flop 55 is set, its output Q becomes "1" and the transistor 40 is turned off, so that the reset signal $\overline{RS}$ is extinguished.

An OR gate 56 supplying a signal to the reset input R of the flip-flop 55 receives at one input thereof a signal "0" by opening of the synchronization start switch $\overline{SS}$ which is in an ON state.

If a signal "1" is supplied from the line 53 to the set input S of the flip-flop 55, the output Q of the flip-flop 55 becomes "1". This causes the transistor 40 to be turned off and the reset signal $\overline{RS}$ to be extinguished. Since the depressed key detection signal KON is supplied from the circuit (FIG. 2) in the automatic bass chord performance device 11 on the line 53, the reset signal $\overline{RS}$ is cancelled when the signal KON is turned to "1" by depression of the key.

If the output of the NOR circuit 42 is designated as RSar, the condition for turning of this output RSar to "1", i.e., the condition for generation of the reset signal $\overline{RS}$ from the side of the automatic rhythm performance device 12, is represented by the following logical equation:

$$RSar=\overline{ST+SS\cdot KON} \quad (2)$$

In the circuit shown in FIG. 2, the depressed key detection signal KON is generated in the following case as well as in the above described case: That is, when the custom function selection switch CA, the single finger function selection switch SF and the finger chord function selection switch FC are all OFF, i.e., the automatic bass chord performance is not selected, and the automatic arpeggio performance selection switch CPY is OFF, all of the inputs of the AND gate 54 become "1" and the output "1" of the AND gate 54 is applied to the AND gate 50 via the OR gate 49 thereby causing the pedal keyboard key depression detection signal PK to be stored in the memory circuit 51.

Accordingly, the conditions for generation of the depressed key detection signal KON are summarized in the following Table 2. In the Table 2, the symbol "o" designates that the switch FC, SF, CA or CPY is ON and the depressed key detection signal KON is generated in response to the lower keyboard key depression signal LK or the pedal keyboard key depression signal PK. The symbol "x" represents that the switches FC-CPY are OFF and the depressed key detection signal KON is not generated in response to the pedal keyboard key detection signal PK. The symbol "—" represents that the switch CPY may either be ON or OFF.

Table 2

| | ABC | | | | KON | |
|---|---|---|---|---|---|---|
| mode | FC, | SF | CA | CPY | LK | PK |
| (1) | x | | x | o | o | x |
| (2) | x | | x | x | o | o |
| (3) | o | | x | — | o | x |
| (4) | x | | o | — | o | o |

Upon setting of the flip-flop 55 by generation of the depressed key detection signal KON and resulting disappearance of the reset signal $\overline{RS}$, the tempo counter 23 starts counting and the automatic rhythm performance is started. Alternatively stated, the automatic rhythm performance is started in synchronization with the key depression in the lower keyboard 15 or the pedal keyboard 16. This is one of the synchronization start function obtained by turning on the synchronization start switch SS. With reference to Table 2, in the mode (1), the automatic rhythm performance is started in synchronization with the key depression (LK ON) in the lower keyboard 15 when the automatic bass chord performance function (ABC) is OFF and the automatic arpeggio performance function (CPY) is ON.

In other words, the automatic rhythm performance is started in synchronization with start of the automatic arpeggio performance by depressing of a key in the lower keyboard 15. In the mode (2), the automatic rhythm performance is started in synchronization with depression of a key in the lower keyboard 15 or the pedal keyboard 16 when such key is depressed (i.e., either LK or PK is ON) in a state wherein both the automatic bass chord performance function and the automatic arpeggio function are OFF. More specifically, if the synchronization start switch SS is turned on when the automatic performance function by operating the keyboard is not selected, the automatic rhythm performance is started in synchronization with a normal key operation (e.g., a manual chord or bass performance using the lower keyboard 15 or the pedal keyboard 16). In the mode (3), the automatic rhythm performance is started in synchronization with depression of a key in the lower keyboard 15 when the finger chord function (FC) or the single finger function (SF) has been selected. In this case, the pedal ekyboard 16 is not used for the automatic bass chord performance so that the pedal keyboard key depression signal PK is not used as the depressed key detection signal KON even if it has been produced. In the mode (4), the automatic rhythm performance is started in synchronization with depression of a key in any of the lower keyboard 15 and the pedal keyboard 16 when the custom function (CA) has been selected in the automatic bass chord performance. In the custom function, the pedal keyboard 16 also is used.

From Table 2, this manner in which the automatic rhythm is stopped in synchronization with release of the depressed key will become apparent. In the mode (3), the depressed key detection signal KON becomes "0" upon release of the key in the lower keyboard 15 designating a chord name or a root tone used in the finger chord function (FC) or the single finger function (SF) and the reset signal $\overline{RS}$ is thereby generated from the side of the automatic bass chord performance device 11. The control circuit in the automatic rhythm performance device 12 is reset by this reset signal $\overline{RS}$ and the automatic rhythm performance is stopped. In the mode (4), the depressed key detection signal KON becomes "0" when all of the keys in the lower keyboard 15 and the pedal keyboard 16 designating the chord name and the root tone of the bass tones in the custom function (CA) have been released, and the reset signal $\overline{RS}$ is thereby generated from the side of the automatic bass chord performance device 11 and the automatic rhythm performance is stopped.

In the control circuit within the automatic arpeggio performance device 13, the reset signal $\overline{RS}$ is generated if an AND gate 61 is enabled. If the output of the AND gate 61 is represented by RScpy, the condition for turning this output to "1" is shown by the following logical equation:

$$RScpy=CPY\cdot SS\cdot\overline{ST}\cdot(\overline{CA}+\overline{PKY})\cdot SFC\cdot\overline{LKO} \quad (3)$$

In the above equation (3), CPY designates a condition which is represented by a signal "1" when the automatic arpeggio performance selection switch CPY is ON, and $SS\cdot\overline{ST}$ designates a condition which is represented by a signal "1" when the rhythm start switch ST is OFF and the synchronization start switch SS is ON. Further, $\overline{CA}+\overline{PKY}$ designates a condition provided for the custom function which is represented by a signal "1" by $\overline{CA}$ when the custom function has not been selected in the automatic bass chord performance device 11. $\overline{PKY}$ is a condition which is represented by a signal "1" when no key is being depressed in the pedal keyboard 16 and by a signal "0" when a key is being depressed in the pedal keyboard 16. In FIG. 1, the normally closed contact type custom function selection switch $\overline{CA}$ and the normally closed contact type pedal keyboard switch $\overline{PKY}$ are provided in parallel to each other between the synchronization start switch SS and the automatic arpeggio selection switch CPY for detecting the condition ($\overline{CA}+\overline{PKY}$). The switch $\overline{CA}$ is interlocked with the switch CA so that when the switch CA is ON, the contact $\overline{CA}$ is opened. The switch $\overline{PKY}$ is coupled with each key of the pedal keyboard so that when a certain key is depressed, the switch corresponding to the depressed key is opened. If, accordingly, even a single key is depressed in the pedal keyboard 16, the switch $\overline{PKY}$ which consists of serially connected normally closed contacts coupled with respective keys is opened. SFC designates a condition which is represented by a signal "1" when a synchronizing clock selection switch SFC is ON. As has previously been described, the counters 24 and 34 for generating the basic tempo clock are driven by the same synchronizing pulse so that the basic tempo clock pulse TCL is synchronized with the basic tempo clock pulse CPL used for the automatic arpeggio performance. $\overline{LKO}$ designates a condition which is represented by a signal "1" when no key is being depressed in the lower keyboard 15. For detecting this condition, the lower keyboard key depression detection signal LKO is generated by a circuit (not shown) in the automatic arpeggio performance device 13. This signal LKO can be generated by utilizing the keyboard code $K_1$, $K_2$ portion of the key code KC outputted by the tone production assignment circuit 19. More specifically, presence of the key code KC concerning the lower keyboard is detected in accordance with contents of the keyboard code $K_1$, $K_2$ which is provided in a time division manner and the depressed key detection signal LKO is formed by converting the detected data into a direct current.

A signal "1" is applied to one of the inputs of the AND gate 61 through the normally closed contact $\overline{ST}$ of the rhythm start switch ST which is OFF, the synchronization start switch SS which is ON, the normally closed contact $\overline{CA}$ of the custom function selection switch CA which is OFF and the automatic arpeggio performance selection switch CPY which is ON. The AND gate 61 also receives a signal "1" through the synchronizing clock selection switch SFC. In this state, the AND gate 61 is enabled by application thereto of the lower keyboard key depression detection signal LKO. If a key is being depressed in the lower keyboard 15 (accordingly, the automatic arpeggio is being performed), the lower keyboard key depression detection signal LKO is "1" and, accordingly, a signal "0" is applied to the AND gate 61 from an inverter 62, so that the AND gate 61 is not enabled. If the key having been depressed in the lower keyboard 15 is released, the lower keyboard key depression detection signal LKD is turned to "0" and a signal "1" is applied to the AND gate 61 from an inverter 62. The AND gate 61 thereupon outputs a signal "1" and one shot of differentiated pulse is outputted by a differentiation circuit 63 at the rise of the output of the AND gate 61. The transistor 41 is turned on by this differentiated pulse and the reset signal $\overline{RS}$ of a short time width corresponding to the differentiated pulse is generated from the side of the automatic arpeggio performance device 13.

The reset signal $\overline{RS}$ generated by the automatic arpeggio performance device 13 is applied to the automatic rhythm performance device 12 and resets the flip-flop 55. Accordingly, the reset signal $\overline{RS}$ is continuously produced from the side of the automatic rhythm performance control device 12. By this arrangement, when one shot of the reset signal $\overline{RS}$ is outputted from the automatic arpeggio performance control device 13 at the moment the automatic arpeggio performance has been stopped, the automatic rhythm performance thereafter is automatically stopped. It should be noted, however, that the automatic arpeggio tones do not cease completely at the same time as the release of the key but there remains a decaying tone. The case is the same with the automatic bass chord performance. If a key is depressed in the lower keyboard 15 and the automatic arpeggio performance is resumed, the flip-flop 55 is set and the stored reset signal $\overline{RS}$ is cancelled as was previously described. Accordingly, the automatic rhythm performance is resumed in synchronization with depression of the key.

A reason for employing the differentiation circuit 63 in generating the reset signal $\overline{RS}$ from the side of the automatic arpeggio performance control device 13 resides in existence of the custom function in the automatic bass chord performance. In the case wherein the custom function has been selected as the automatic bass chord performance, the normally closed contact $\overline{CA}$ is opened. Assume now that depression of a key is made only in the lower keyboard 15 and not in the pedal keyboard 16 notwithstanding that the custom function has been selected. In this case, the automatic chord tones and the automatic arpeggio tones are produced and no automatic bass tones are produced. Since no key is being depressed in the pedal keyboard 16, the pedal keyboard switch $\overline{PKY}$ is all closed. Accordingly, a signal "1" is applied from the contact $\overline{ST}$ to the AND gate 61 through the switch CPY. If the depressed key in the lower keyboard 15 is released in this state, the signal LKO becomes "0" thereby enabling the AND gate 61. If the output of the AND gate 61 is applied directly to the transistor 41 without providing the differentiation circuit 63 thereby generating the reset signal $\overline{RS}$ continuously from the side of the automatic arpeggio performance device 13 so long as the key is kept released in the lower keyboard 15, there arises the inconvenience that the reset signal $\overline{RS}$ is not cancelled when a key is depressed in the pedal keyboard 16 and, accordingly, the automatic rhythm performance and the automatic bass performance are not started. For preventing such inconvenience, the differentiation circuit 63 is provided so that the short reset signal $\overline{RS}$ is generated at the moment the key has been released in the lower keyboard 15. In the present embodiment, if a key is depressed in the pedal keyboard 16, the pedal keyboard switch $\overline{PKY}$ is opened and the AND gate 61 thereby is disenabled. Accordingly, it is possible to start the automatic rhythm performance in synchronization with the key depression in the pedal keyboard 16 without providing the differentiation circuit 63. The provision of the AND gate 63 is useful in a case where the condition ($\overline{CA}+\overline{PKY}$) is not provided as a condition for enabling the AND gate 61, i.e., the parallel circuit of the custom function selection switch $\overline{CA}$ and the pedal keyboard switch $\overline{PKY}$ is not inserted between the synchronization start switch SS and the automatic arpeggio selection switch CPY. It is a feature of the present invention that a reset pulse of a sharp and short pulse form is used if a keyboard which is unrelated to a selected automatic performance function is used by another automatic performance function.

In the case where the custom function has been selected as the automatic bass chord performance, if a key is depressed while all keys are released in the lower keyboard 15, the depressed key detection signal KON is produced from the automatic bass chord performance device 11 and the reset signal $\overline{RS}$ stored in the automatic rhythm performance device 12 is cancelled so that the automatic rhythm performance is started. If a key in the lower keyboard 15 is repeatedly depressed and released (i.e., the automatic arpeggio is repeated) while the key in the pedal keyboard 16 is kept depressed, the lower keyboard key depression detection signal LKO is repeatedly generated and extinguished in the automatic arpeggio performance device 13. If the condition $(\overline{CA}+\overline{PKY})$ in the logical equation (3) was not provided as a condition for enabling the AND gate 61, generation and extinguishment of the reset signal $\overline{RS}$ from the automatic arpeggio performance device 13 would be repeated in accordance with repetition of depression and release of the key in the lower keyboard 15 and, accordingly, the automatic rhythm performance (and the automatic bass performance) would be started and stopped repeatedly notwithstanding that the key is kept depressed in the pedal keyboard 16. For preventing such inconvenience, the condition $(\overline{CA}+\overline{PKY})$ is added to the condition for enabling the AND gate 61 in the embodiment shown in FIG. 1. In the case where the custom function has been selected as the automatic bass chord performance, the switch $\overline{CA}$ is opened. If a key in the pedal keyboard 16 is depressed in this state, the pedal keyboard switch $\overline{PKY}$ is opened and a signal supplied from the automatic arpeggio performance selection switch CPY to the AND gate 61 is turned to "0". If, accordingly, a key is depressed in the pedal keyboard 16 in the custom function mode, generation of the reset signal $\overline{RS}$ from the automatic arpeggio performance device 13 is prevented. It is a feature of the present invention that if a keyboard unrelated to a selected automatic performance function is required for another automatic performance function, the key depression in that keyboard participates in condition for generating the reset signal $\overline{RS}$ from the side of the selected automatic function.

The manner of utilizing the reset signal $\overline{RS}$ in the automatic arpeggio performance device 13 is different from that in the other devices 11 and 12. The reset signal $\overline{RS}$ provided through the mutual reset line 37 is applied to the differentiation circuit 60. The differentiation circuit 60 outputs one shot of differentiated pulse when the input signal has risen from "0" to "1". Accordingly, when the reset signal $\overline{RS}$ has just been generated (i.e. the input signal of the differentiation circuit 60 has been turned from "0" to "1"), the differentiation circuit does not produce an output, but when the reset signal $\overline{RS}$ has been extinguished, the differentiation circuit 60 produces one shot of pulse. This output of the differentiation cicuit 60 is applied to the reset terminals of the counters 24 and 34. Accordingly, the counters 24 and 34 are reset at the instant when the reset signal $\overline{RS}$ has been extinguished and the counters 24 and 34 start their counting operation immediately thereafter. The differentiated pulse outputted by the differentiation circuit 60 is utilized also in a circuit (not shown) in the automatic arpeggio performance device 13. This unillustrated circuit functions to bring the control operation for the automatic arpeggio performance back to an initial state (e.g., a state established at the initial state of key depression) in response to the differentiated pulse supplied by the differentiation circuit 60. At this time, the automatic bass chord performance and the automatic rhythm performance are started in the other performance devices 11 and 12 for the reset signal $\overline{RS}$ has extinguished.

Accordingly, the automatic arpeggio is performed so long as a key is depressed in the lower keyboard 15 even if the reset signal $\overline{RS}$ is being supplied to the automatic arpeggio performance device 13. Further, time for starting the automatic arpeggio performance and time for starting the automatic rhythm performance can be synchronized by restoring the initial state of the automatic arpeggio performance in synchronization with starting of the automatic rhythm performance which is effected in response to extinguishment of the reset signal $\overline{RS}$, notwithstanding that the automatic arpeggio is being performed. This control is effected in a case where the rhythm start switch ST is turned on or off when the synchronization start switch SS is in an OFF state and the reset signal $\overline{RS}$ thereby is generated or extinguished on the side of the automatic rhythm performance device 12.

What is claimed is:

1. An electronic musical instrument including a plurality of automatic performance devices of different functions, said instrument comprising:

a common control line connecting said automatic performance devices to one another, each one of said automatic performance devices comprising:

a control signal delivery circuit which, in response to a performance stop instruction provided to that one automatic performance control device, delivers out a control signal on said common control line, and a control signal receiving circuit which detects presence or absence of the control signal on said common control line and thereby controls the performance operation of that one automatic performance device.

2. An electronic musical instrument as defined in claim 1 wherein said control signal delivery circuit is an on-off switch circuit operatively connected to said common control line producing and extinguishing the control signal on said common control line in accordance with turning on and off of the on-off switch circuit.

3. An electronic musical instrument as defined in claim 1 wherein each of said automatic performance devices includes a counter for advancing the automatic performance function of that device, and wherein said control signal receiving circuit is a circuit resetting and starting a counting operation of the counter for that automatic performance device in accordance with the presence or absence of the control signal of a change in the control signal.

4. An electronic musical instrument as defined in claim 1, said instrument having at least one keyboard, and wherein one of the automatic performance devices has an automatic rhythm performance function which operates independently of key depression in any of said keyboards and wherein another of the automatic performance devices has an automatic performance function associated with depression of a key in a predetermined one of said keyboards and which comprises a switch actuated for operating the automatic rhythm performance device in synchronization with the device having the automatic performance function associated with the key depression in the predetermined keyboard, and a circuit for extinguishing the control signal in response to a signal representative of the key depression in the predetermined keyboard thereby to start the automatic rhythm performance.

5. An electronic musical instrument as defined in claim 4 in which said automatic performance device having the automatic performance function associated with the key depression in the predetermined keyboard comprises a circuit which delivers out the control signal in accordance with release of the depressed key when a switch for selecting a predetermined performance function has previously been selected.

* * * * *